US005381857A

United States Patent [19]

Tozawa et al.

[11] Patent Number: 5,381,857

[45] Date of Patent: Jan. 17, 1995

[54] APPARATUS AND METHOD FOR CONTINUOUS CASTING

[75] Inventors: Hirokazu Tozawa; Shuji Takeuchi; Kenichi Sorimachi; Tetsuya Fujii; Noboru Yasukawa; Saburo Moriwaki; Mitsuru Sakurai; Makoto Aratani; Yoshiro Tomiyama, all of Chiba; Takeshi Shiraishi, Tokyo, all of Japan

[73] Assignee: Kawasaki Steel Corporation, Japan

[21] Appl. No.: 205,349

[22] Filed: Mar. 3, 1994

Related U.S. Application Data

[63] Continuation of Ser. No. 991,478, Dec. 15, 1992, abandoned, which is a continuation of Ser. No. 742,094, Aug. 2, 1991, abandoned, which is a continuation of Ser. No. 512,756, Apr. 20, 1990, abandoned.

[30] Foreign Application Priority Data

Apr. 27, 1989 [JP] Japan ..... 1-105817
Oct. 30, 1989 [JP] Japan ..... 1-279958

[51] Int. Cl.[6] ..... B22D 27/02
[52] U.S. Cl. ..... 164/466; 164/502
[58] Field of Search ..... 164/502, 504, 466, 468

[56] References Cited

U.S. PATENT DOCUMENTS 2,743,492 5/1956 Easton ..... 164/502
4,495,984 1/1985 Kollbers ..... 164/468

FOREIGN PATENT DOCUMENTS 58-55157 4/1983 Japan ..... 164/466
61-129261 6/1986 Japan ..... 164/466
63-154246 6/1988 Japan ..... 164/466
64-66052 3/1989 Japan ..... 164/466

*Primary Examiner*—Kuang Y. Lin
*Attorney, Agent, or Firm*—Austin R. Miller

[57] ABSTRACT

One or more streams of molten metal poured into a continuous casting mold are acted on magnetically by static magnetic fields, covering substantially the entire width of the casting mold, thereby reducing the speed of the molten metal streams from the immersion nozzle, unifying the flow profile of the molten metal in the mold, preventing trapping and accumulating of mold powders and inclusions into the cast products. Magnetic poles are provided which are at least as wide as or wider than the minimum width of the cast products and the iron core is arranged on the same face of the casting mold with mutually opposite polarities in the drawing direction. Even if casting conditions change from time to time, defects in final products made of the cast metal are substantially reduced.

16 Claims, 13 Drawing Sheets

*Fig. 1*
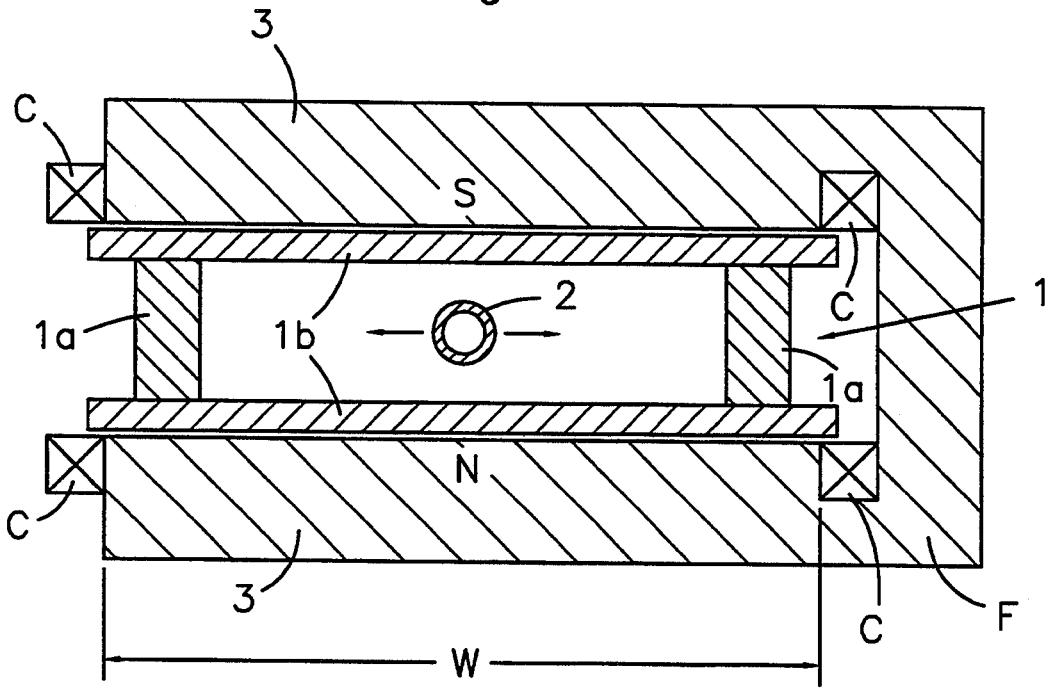
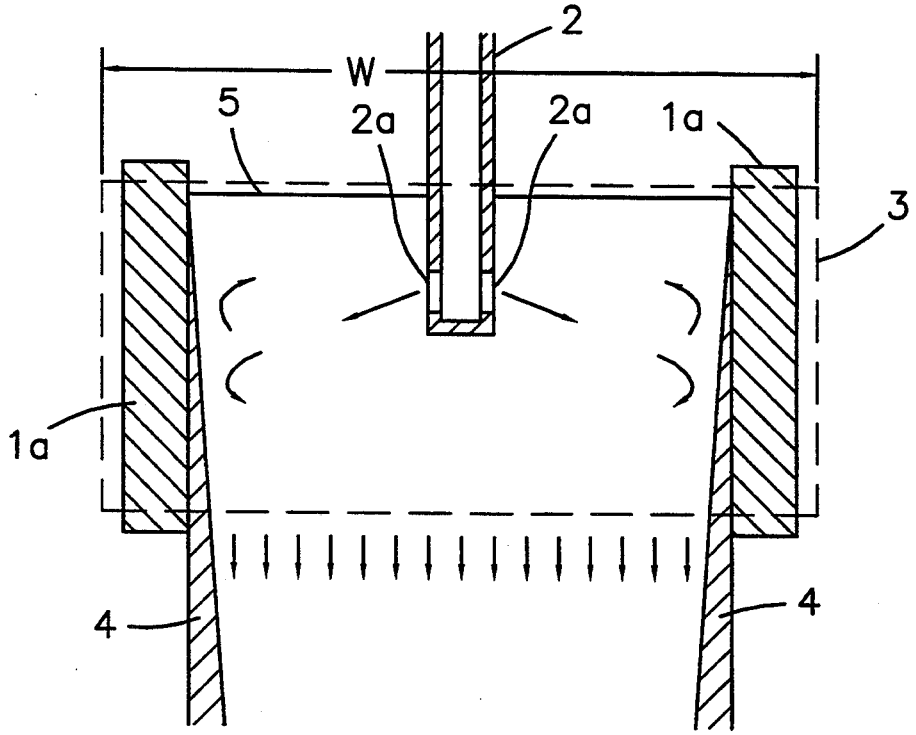
*Fig. 2*

Magnetic Flux Density

Magnetic Flux Density

APPARATUS AND METHOD FOR CONTINUOUS CASTING

This application is a continuation of application Ser. No. 07/991,478 filed Dec. 15, 1992, which is a continuation of application Ser. No. 07/742,094, filed Aug. 2, 1991, which is a continuation of application Ser. No. 07/512,756, filed Apr. 20, 1990 and all abandoned.

TECHNICAL FIELD

This invention relates to the continuous casting of steel or equivalent ferrous or other metal which is influenced by a magnetic field.

BACKGROUND OF THE INVENTION

Defects in final products, such as internal defects (detectable by ultrasonic testing) and surface defects such as blisters and sliver defects are often found in the rolled final product. Such defects are caused by trapping and accumulating nonmetallic inclusions, mold powders and bubbles in the cast products when molten magnetic metal, particularly steel is continuously cast in a curved continuous casting machine.

Prior art attempts to prevent these defects include the following:

1. Cleaning up the molten metal by using various ladle refining processes.
2. Preventing reoxidization of the molten metal by fastening the seals of the tundish.
3. Superheating the molten metal and causing the inclusions to float up in the mold to mold powders at the meniscus which results in removal of the inclusions from the molten metal.
4. Preventing the particles of the ladle slag and the tundish powders from being trapped into the cast products by using a large volume tundish.
5. Installing a vertical bending machine to float up the inclusions, and absorbing them into the molten mold powders at the meniscus.
6. Preventing inclusions and mold powders from being trapped in the cast products by reforming the immersion nozzle profile.
7. Trapping inclusions and mold powders with trapping boards installed at the outlet of the immersion nozzle ports.
8. Preventing the jet streams of the molten metal from penetrating into the molten metal pool in the slab by installing reflecting boards at the outlets of the immersion nozzle ports.

However, these prior art procedures have not been found to be sufficient to clean the molten metal in actual plant manufacturing processes which are required to meet targeted high quality levels.

Inclusions, mold powders and bubbles which are introduced into the molds of continuous casting machines are trapped and accumulated in the cast products when the throughput speed of the molten metal exceeds a definite value. It is typically not possible to remove them by floating them up to the molten mold powders on the meniscus when throughput speeds exceed the definite value.

It was also common practice to attempt to control the jet streams of the molten metal ejected from the immersion nozzles by optimizing the profiles of the outlet ports of the immersion nozzle or by reducing the casting speed. But these attempts were not sufficient to prevent defects caused by trapping or accumulating inclusions or mold powders introduced into the molten metal.

An electromagnetic brake (EMBR) system was proposed to cope with these problems as reported in Iron Steel Eng. May 1984 p.41–p.47, J. Nagai, K. Suzuki, S. Kozima and S. Kallberg, and also in U.S. Pat. No. 4,495,984. The braking force was obtained by introducing static magnetic fields perpendicular to the flow direction of the molten metal jets from the immersion nozzle. The difference in speed between the molten metal in the jets and the rest of the mold created a voltage and thus created eddy currents. These eddy currents interacted with the static magnetic field, creating a braking force (Lorentz force), which acted in a direction of opposed to the metal flow.

The attempted effects of the EMBR system were reducing the flow velocity of the molten metal in the mold, preventing trapping and accumulating mold powders and inclusions into the cast products and floating the inclusions introduced into the molten metal. Under certain conditions the system reduced the internal defects (detectable by ultrasonic testing) of the final products caused by the mold powders, and reduced the trapping and accumulating inclusions in the upper half of the strands in the curved mold casters. It was believed that increasing the flow velocity of the molten metal jet from the nozzle would provide a more effective braking effect than other methods because the braking effect of the Lorentz force was proportional to the jet stream speed.

However, under commercial casting conditions it was often experienced that the effects of the EMBR system were not enough and that the EMBR system actually damaged the quality of the cast products, especially in high speed casting.

According to U.S. Pat. No. 4,495,984, the flow direction of the jet streams of the molten metal can be changed by the EMBR system as though the streams had collided against a wall, but it is in fact impossible to obtain uniform flow by splitting the energy of the jet streams, and the jet streams tend to be diverted toward a direction where the static magnetic field is not in effect.

Many ideas directed to the arrangement of the iron cores were proposed to optimize the static magnetic field in the continuous casting mold.

Japanese patent Kokai 59-76647 disclosed the idea of reducing the speed of the molten steel and splitting and stirring the streams of the molten steel by forming a static magnetic field just below a continuous casting mold.

Japanese patent Kokai 62-254955 disclosed various sizes and arrangements of the iron cores in a continuous casting mold.

Japanese patent Kokai 63-154246 disclosed the idea of arranging the magnetic poles at the meniscus and/or the bottom of a continuous casting mold.

However these prior art processes were defective and caused inclusions to accumulate deeply in the cast products when the casting conditions (such as casting speed, dimensions of the cast products, profile of the immersion nozzle and the level position of the meniscus) were changed and differed from definite optimum conditions.

In other words, these prior art processes were able to brake the streams of molten metal only under certain specific conditions, but once the casting conditions were changed, the beneficial effects of the EMBR system were reduced or sometimes the EMBR system even degraded the quality of the cast products.

OBJECTS OF THE INVENTION

It is accordingly an object of the invention to provide an apparatus and method for continuously casting a magnetic metal to provide a product containing a minimum of impurities. A further object is to make continuously cast products at production line speeds with a purity heretofore unobtainable.

Still another object is to produce continuously cast steel with removal of impurities that cause surface defects in final rolled products, and to make such products that are essentially free of surface defects such as blisters and sliver defects.

Yet another object of this invention is to avoid trapping or accumulating nonmetallic inclusions, mold powders or bubbles in continuously cast products.

Other objects and advantages of the invention, including the effectiveness of the invention over a wide range of operating parameters, will further become apparent hereinafter and in the drawings, of which:

BRIEF DESCRIPTION OF THE DRAWINGS

FIG. 1 is a top plan view showing an example of the construction and arrangement of one form of continuous casting mold used in the practice of the invention.

FIG. 2 is a view in vertical section of the mold of FIG. 1.

Figure 3:
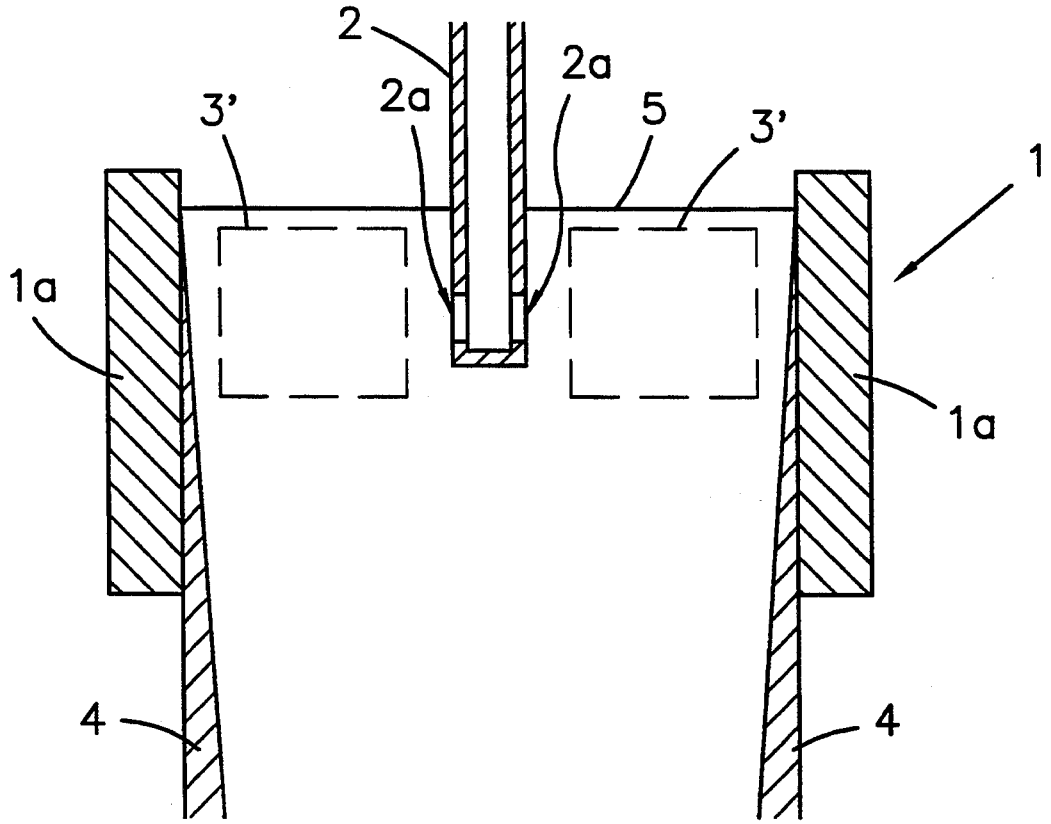
Fig. 3 (PRIOR ART)
FIG. 3 is a view in vertical section showing a prior art continuous casting mold.

The following description is specifically directed to those forms of the invention shown in the drawings and is not intended to limit the scope of the invention.

SUMMARY OF THE INVENTION

According to this invention an effective continuous casting machine and method is provided. This is achieved by projecting a static magnetic field substantially covering the entire width of the casting mold.

Preferably according to this invention the static magnetic fields are formed at a band area including the outlet ports of the immersion nozzle or at a band area above the outlet ports of the immersion nozzle or at a band area below the immersion nozzle outlet ports or at band areas above and below the immersion nozzle outlet ports.

According to this invention the width of the iron core must be greater than the inner width of the casting mold to form substantially uniform static magnetic fields.

DETAILED DESCRIPTION OF THE APPARATUS AND METHOD SHOWN IN THE DRAWINGS

FIGS. 1 and 2 show a form of a continuous casting machine of this invention. The continuous casting mold 1 is formed by a pair of narrow faces plates 1*a* and a pair of wide faces 1*b*. The immersion nozzle 2 is used to supply molten magnetic metal such as steel into the mold 1. The magnetic poles 3,3, consisting of coils C,C and iron core F, have a width W substantially covering the whole width of the casting mold 1, and which project a static magnetic field covering the whole width of the continuous casting mold. As shown in FIG. 2, the immersion nozzle 2 has oppositely directed side discharging outlet ports 2*a*,2*a* directed toward the narrow faces 1*a*,1*a* of the casting mold 1. Magnetic poles 3 cover substantially the entire mold width. The number 4 designates the solidified shell of the cast product and the number 5 designates the meniscus.

Figure 12:
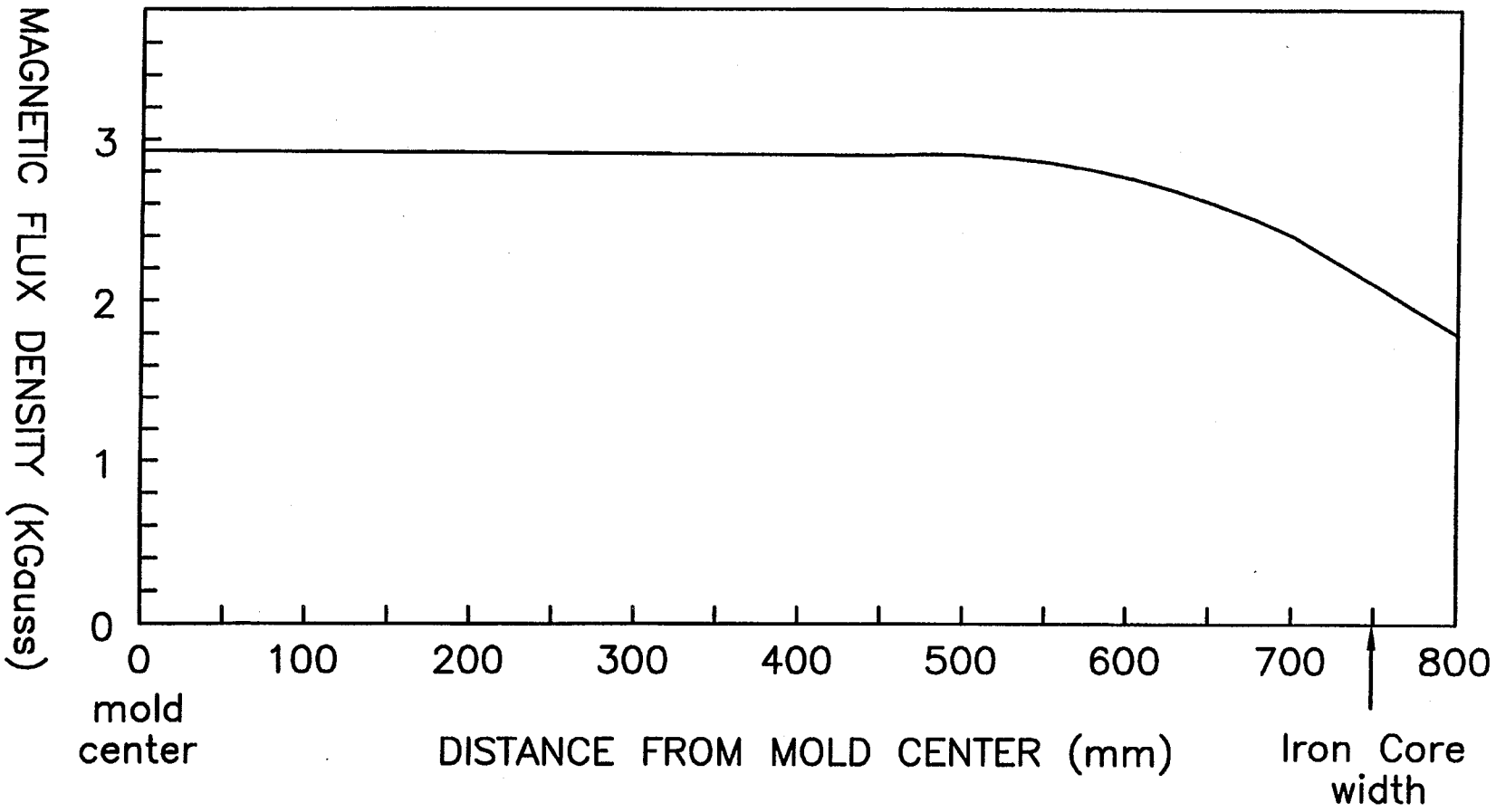
FIG. 12 is a graph showing the magnetic flux density by three-dimensional magnetic field analysis at the centers of the magnetic poles.

FIG. 12 of the drawings shows a typical profile of the magnetic flux density resulting from a three-dimensional magnetic field analysis. The uniform magnetic flux density can be obtained from the center of the iron core to 75% width of the iron core. At the end of the iron core, the density of the magnetic flux decreases, so it is important in order to obtain a substantially uniform magnetic field that the width of the iron core must be at least as wide as or wider than the width of the casting mold.

FIG. 3 shows a prior art device. Magnetic poles 3' do not cover the entire mold width and are arranged at specific positions of limited area along the casting mold 1, and form static magnetic fields in the casting mold, which interact with eddy currents induced in the molten metal, applying a braking force (Lorentz force) to the streams of molten metal. But in this prior art casting apparatus, the optimum arrangement of the magnetic poles in the mold must be considered carefully. In case of changing casting conditions, it has been found very difficult to obtain high quality cast products.

Figure 13:
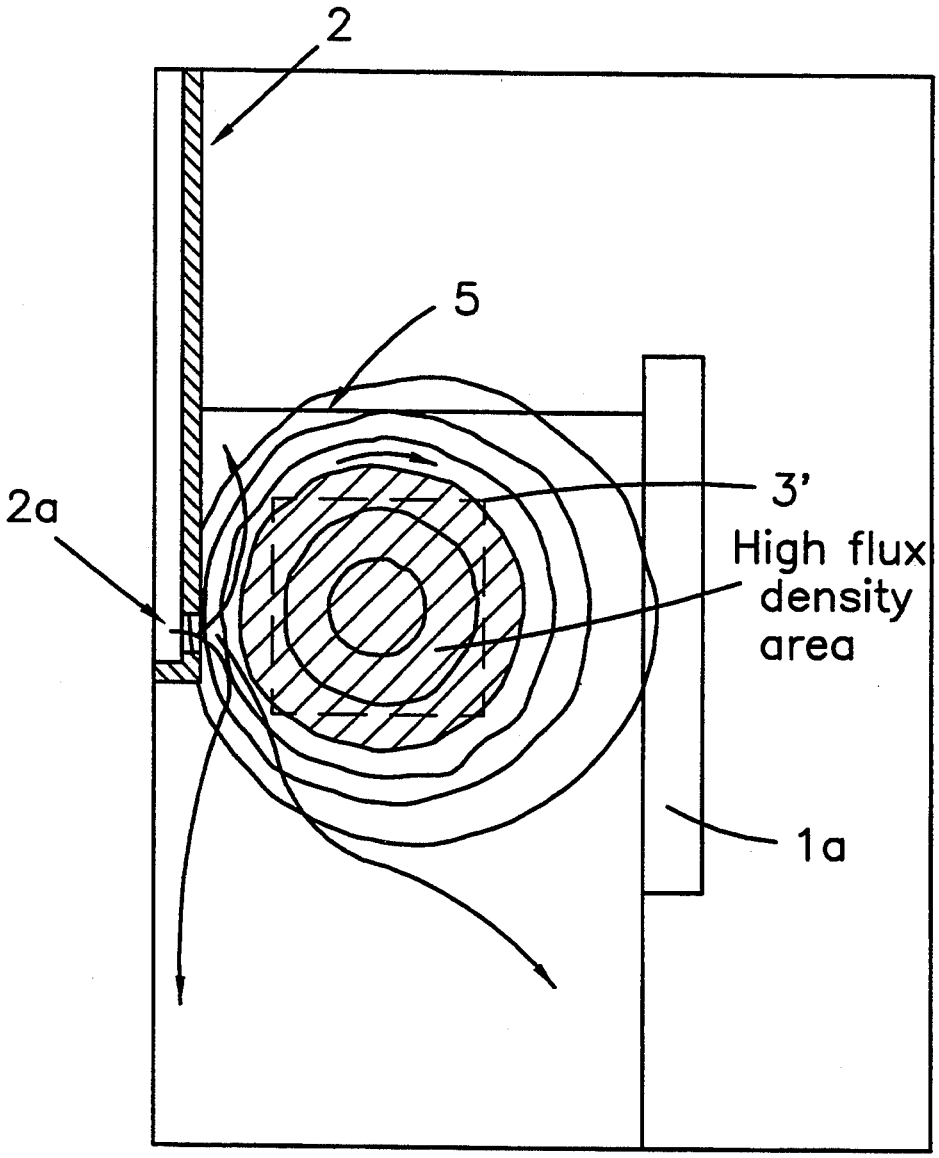
Fig. 13 (PRIOR ART)
FIG. 13 is a contour of the magnetic flux density and the flow of the molten metal at the mid-thickness in a product of the prior art.

FIG. 13 shows the contour of the magnetic flux density obtained according the prior art casting apparatus of FIG. 3, with sketchy main stream flows. A strong magnetic field must be arranged to brake the jet streams from the immersion nozzle 2. As shown by the arrows in FIG. 13 reflected streams of the molten metal are induced by the blocking action of the strong magnetic field, and these reflected streams sometimes spoil the quality of the cast products, even as compared to ordinary casting without a magnetic field.

According to the prior art it was found very important to arrange the magnetic poles in the optimum position in the continuous casting mold, considering the main streams of the molten metal, and it was often experienced that the optimum pole position differed according to the actual casting conditions, and it was not always possible to obtain the maximum effects of the EMBR system to be free from the defects caused by the reflected streams.

According to this invention the magnetic poles 3 are installed at the outer surfaces of the casting mold 1, forming static magnetic fields which cover substantially the entire width of the continuous casting mold 1*b*. Accordingly the jet stream speed of the molten metal from the outlet ports of the immersion nozzle is reduced drastically and said magnetic fields act in the manner of reflecting boards to change the direction of the molten metal streams controllably.

We have found through many experiments according to this invention that the jet streams of the molten metal are changed into reduced streams which were uniform and directed downwardly in the direction in which the cast products were pulled out from the continuous casting machine. This was found to be effective even if the casting conditions such as the outlet angle of the immersion nozzle, the immersed depth of the immersion nozzle and the casting speed were changed.

Figure 4:
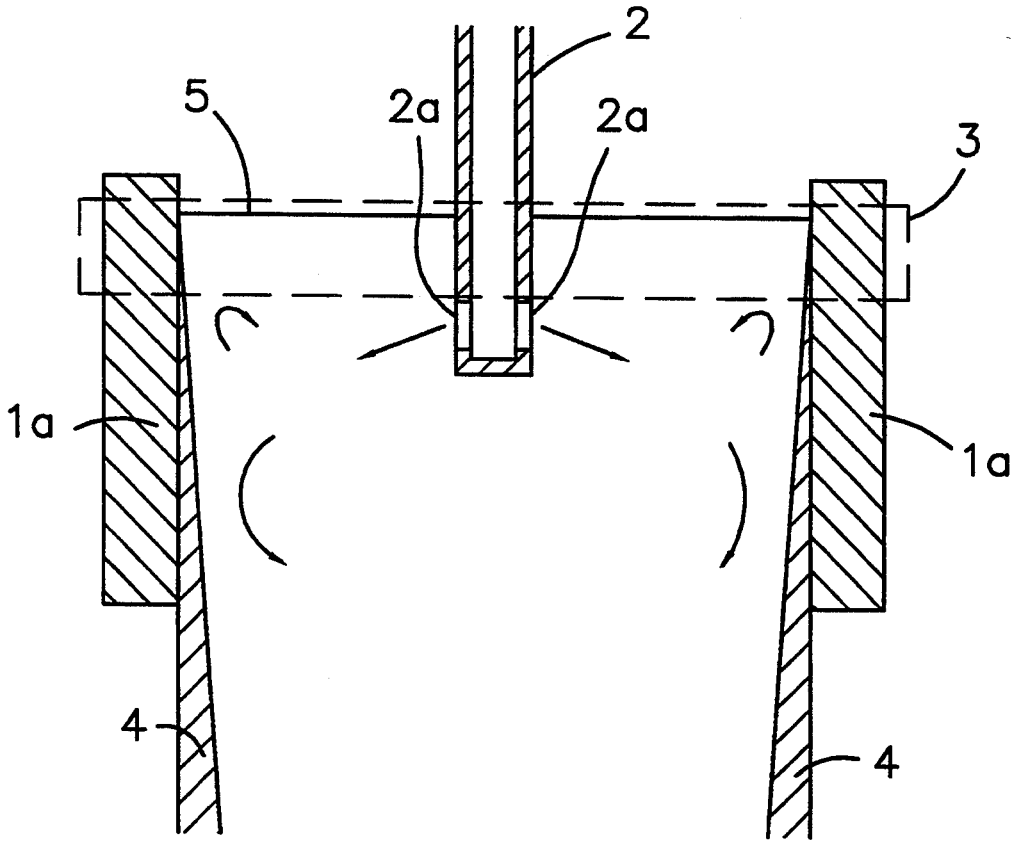
FIG. 4 is a view in vertical section of a mold showing an alternative form of the invention.
Figure 5:
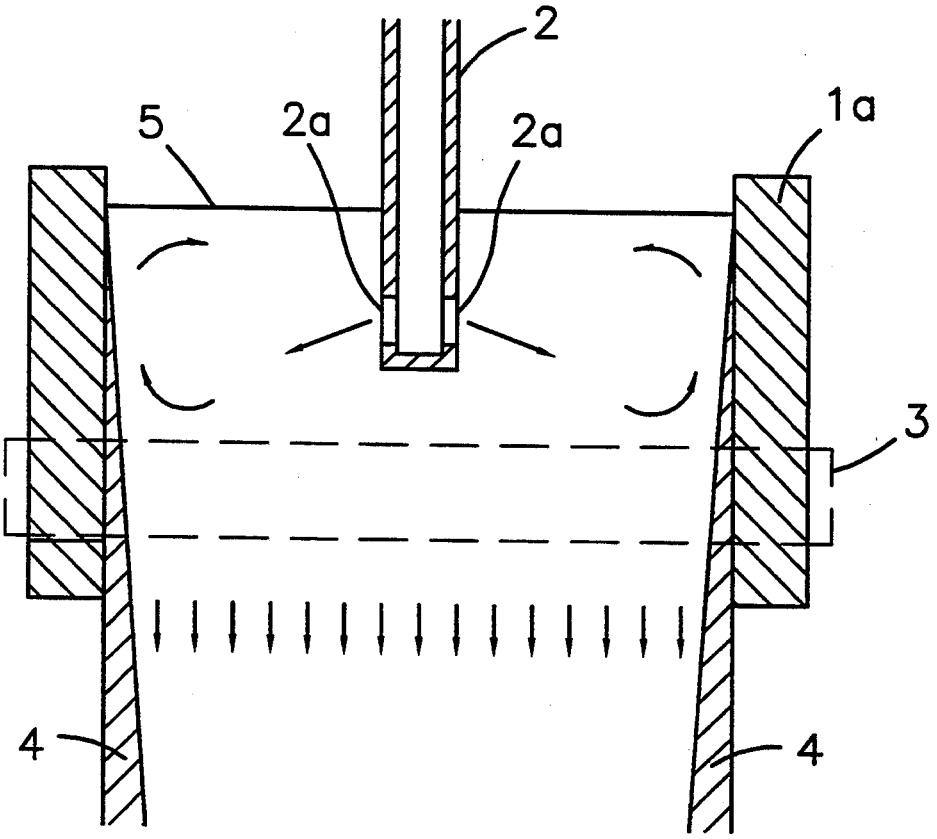
FIG. 5 is a view in vertical section showing a continuous casting mold similar to that of FIG. 4, but in a different operative position.

We will now describe various embodiments as shown in FIGS. 2, 4 and 5, keeping in mind that the top plan view of FIG. 1 applies to all three of these figures.

FIG. 2 shows the magnetic pole 3 arranged to cover the outlet ports 2*a* of the immersion nozzle 2 and substantially the entire width of the casting mold 1*b*. In this arrangement the jet stream speeds of the molten metal are reduced and the flow profile is unified preventing trapping of mold powders and accumulating inclusions into the cast products regardless of the casting conditions such as outlet angle of the immersion nozzle, the immersed depth of the immersion nozzle, the casting speed and the width of the casting mold, for example.

FIG. 4 shows the magnetic pole 3 arranged to cover the band area above the immersion nozzle ports 2*a* and substantially the entire width of the casting mold 1*b*. In this arrangement the jet streams of the molten metal are prevented from reaching and disturbing the meniscus 5, so that trapping of mold powders on the meniscus and into the cast products is effectively avoided.

FIG. 5 shows the magnetic pole 3 arranged to cover the band area below the immersion nozzle ports 2*a* and substantially the entire width of the casting mold 1*b*. In this arrangement the jet streams of the molten metal are prevented from penetrating deeply into the crater, whereby trapping and accumulating inclusions in the molten metal into the cast products is effectively avoided.

Figure 6:
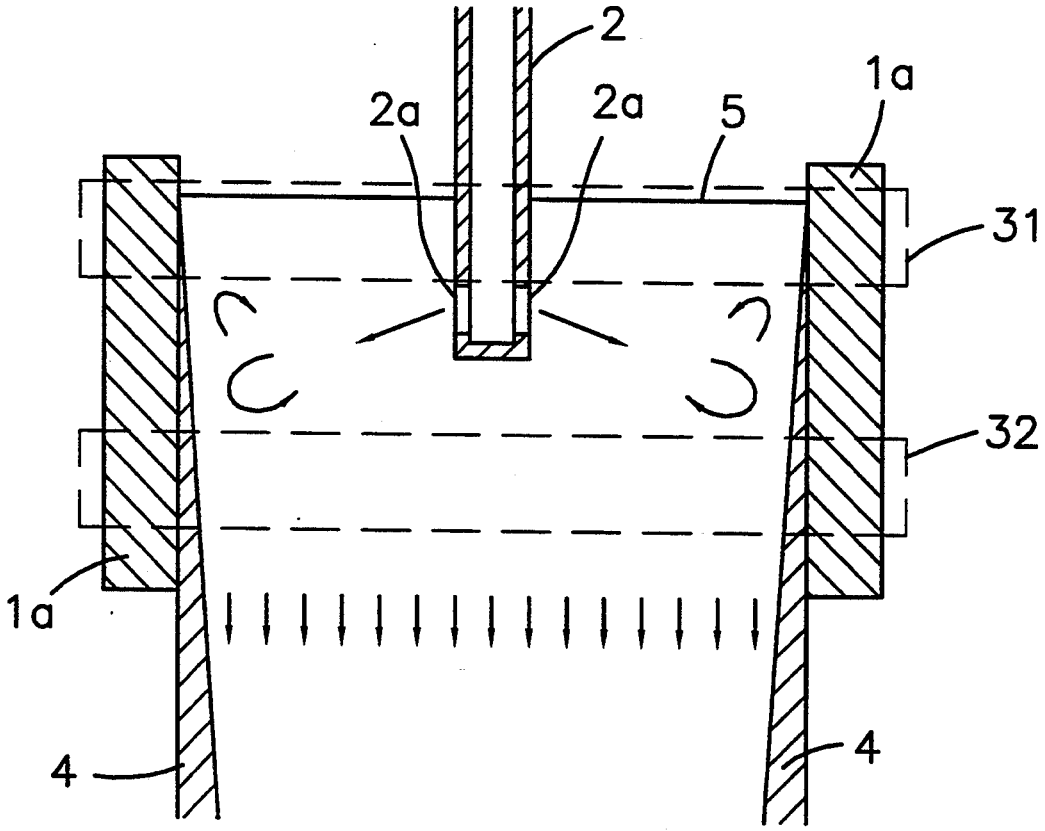
FIG. 6 is a view in vertical section of a continuous casting mold comprising an alternative form of the invention.
Figure 14:
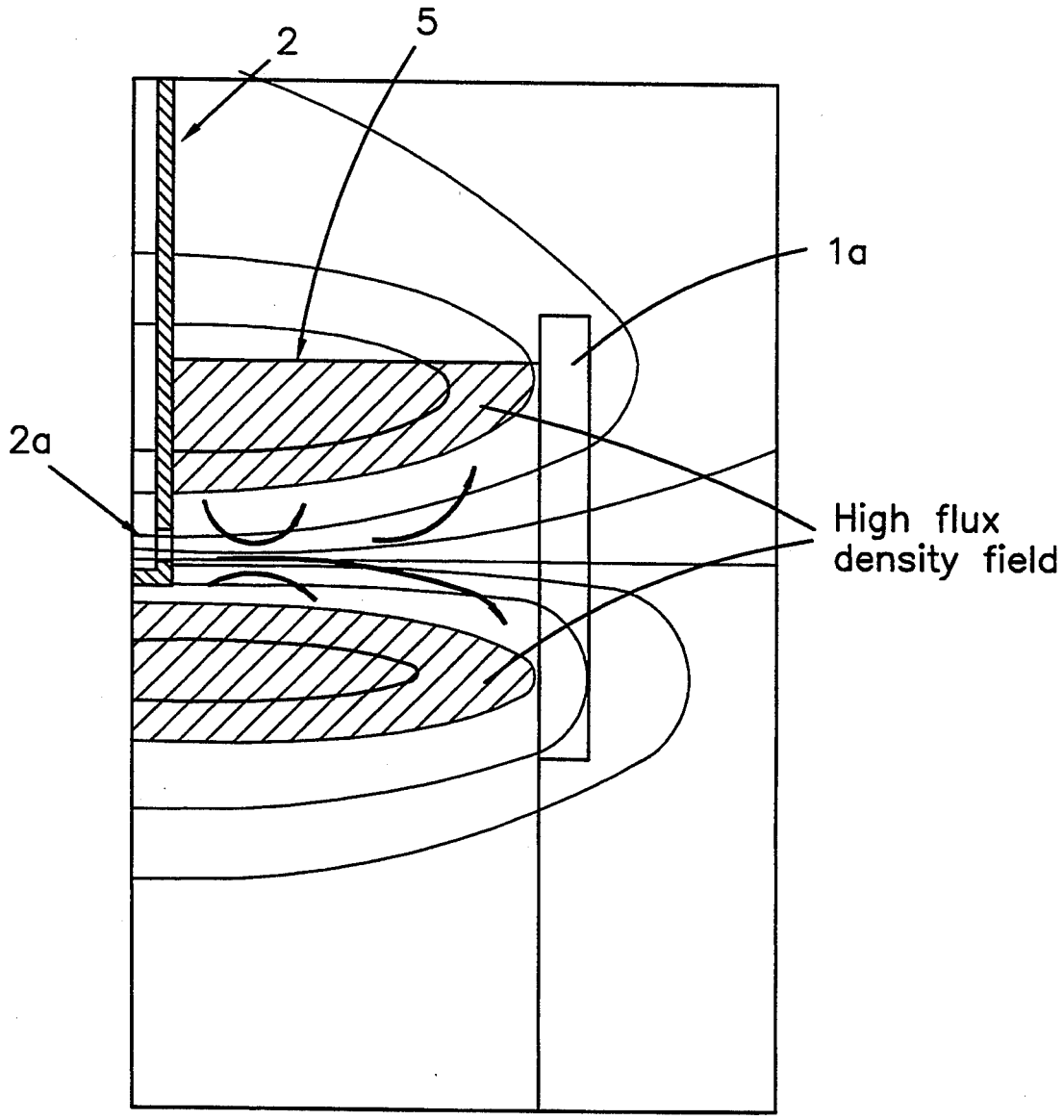
FIG. 14 is a contour of the magnetic flux density and the flow of the molten metal at the mid-thickness of FIG. 6.

FIG. 6 shows that two magnetic poles 31 and 32 are arranged to cover the band areas above and below the immersion nozzle ports 2*a* and substantially the entire width of the casting mold 1*b*. According to this arrangement, the jet streams of the molten metal are contained between the magnetic fields formed by the poles, as shown in FIG. 14, preventing disturbing the meniscus and penetrating deeply into the crater of the molten metal at the same time.

FIGS. 1, 2, 4 and 5 show only one pair of magnetic poles, while FIG. 6 shows two pairs of magnetic poles. When the jet stream velocity is extremely high, it is desirable to arrange another magnetic pole pair or pairs in the casting mold to reinforce the beneficial effects of this invention.

Figure 9:
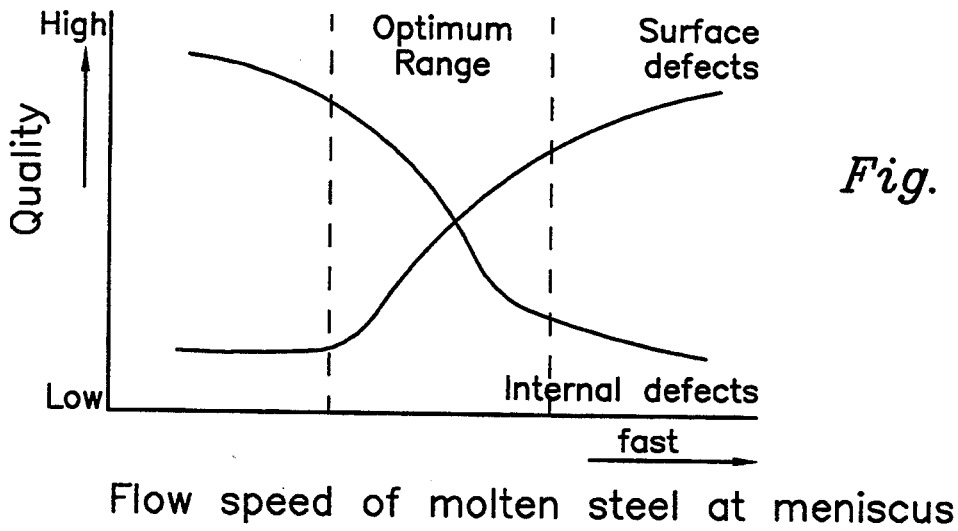
FIG. 9 is a diagram showing the amount of the surface and internal defects in the final products versus the stream flow speed of the molten metal at the meniscus.

The magnetic flux density of the magnetic field should be controlled according to the casting conditions such as dimensions of the cast products and casting speed. When the outlet speed from the immersion nozzle is high, that is the casting speed is high or the casting width is great, a higher magnetic flux density of the magnetic field is required to brake the streams of the molten metal effectively and to unify the flow pattern. But if the magnetic flux density is too high to prevent supplying the heat up to the meniscus, the amount of surface defects caused by solidified crusts on the meniscus increases as shown in FIG. 9. As mentioned above, it is important to control the magnetic flux density practicing in this invention.

A higher density of the magnetic flux is required to unify the downwardly directed streams of the molten metal in the casting mold than to reduce the flow speed at the meniscus. We have found that, in the case of FIG. 6, it is beneficial to control the density of the magnetic field to produce a lower density (2400–3200 Gauss in Example 4) at the upper magnetic pole 31 than the density (3200 Gauss in Example 4) at the lower magnetic pole 32. In this situation, there should exist a non-magnetic space, which includes the outlet port of the immersion nozzle, between the upper magnetic and lower magnetic field.

Figure 15:
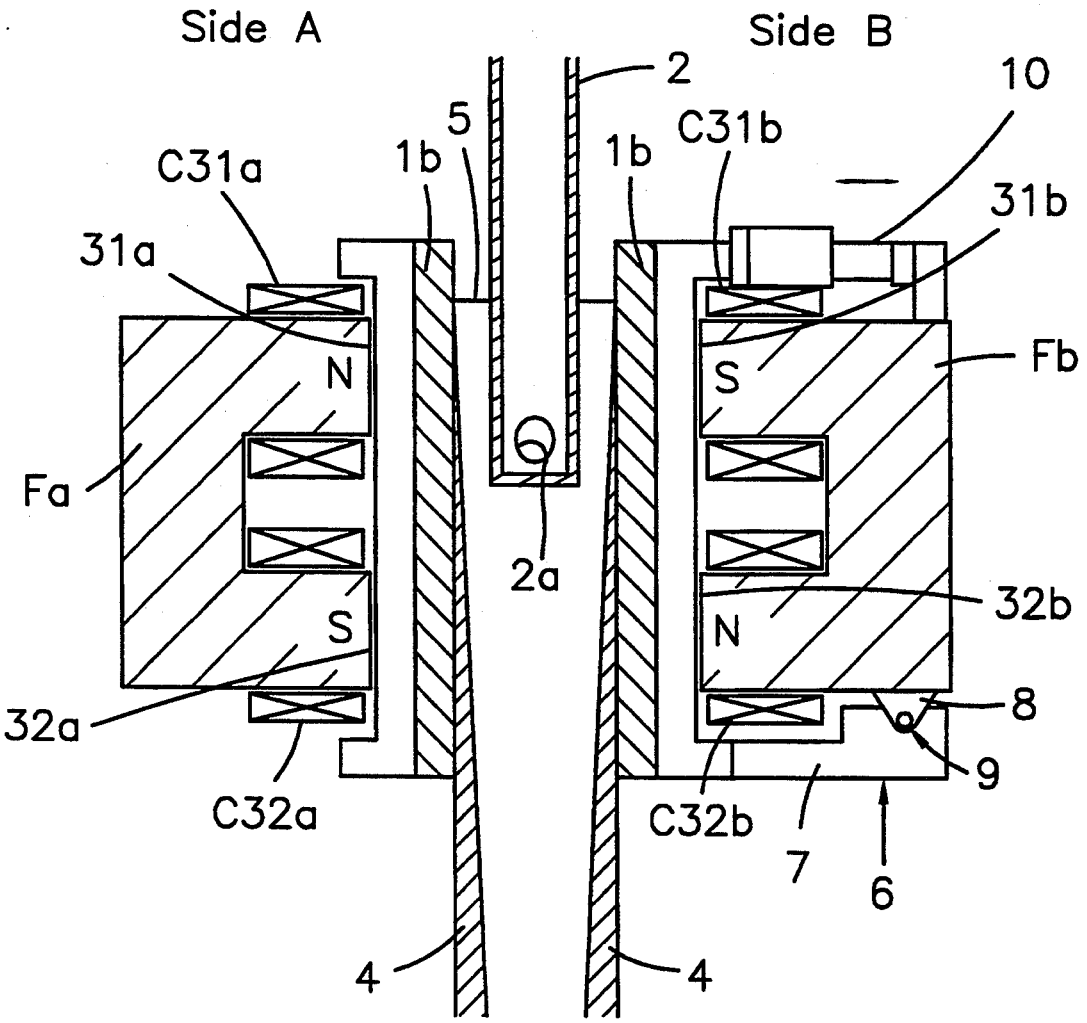
FIG. 15 is a vertical section of another embodiment of this invention.

FIGS. 6 and 15 show an apparatus of this invention, showing a continuous casting mold 1 consisting of a pair of narrow face plates 1*a*,1*a* and wide face plates 1*b*,1*b* made of copper, copper alloy or copper coated plate and being water cooled; an immersion nozzle 2; an iron core Fa having an upper magnetic pole 31*a* and a coil c31*a* and a lower magnetic pole 32*a* and a coil c32*a*; an iron core Fb having an upper magnetic pole 31*b*, a coil c31*b*, a lower magnetic pole 32*b* and a coil c32*b*; a magnetic flux density controlling device 6 affixed on iron core Fb comprising a bracket 7 affixed to a support frame, a bracket 8 affixed to iron core Fb, a hinge pin 9, connecting brackets 7 and 8, a hydraulic cylinder 10 connecting iron core Fb and a support frame.

In operation of the apparatus of FIG. 15, when the upper magnetic pole 31*a* has an "N" polarity, and 31*b* has an "S" polarity, the magnetic field flux is projected from side A to side B at the upper magnetic poles 31*a*, 31*b* and from side B to side A at the lower magnetic poles 32*a*, 32*b*. When molten metal is introduced in the above described magnetic fields, molten metal streams having an upward flow direction are resisted or slowed by the upper magnetic field. Similarly, molten metal streams having a downward flow direction are resisted or slowed by the lower magnetic field. In cases where the upper magnetic field between 31*a* and 31*b* and the lower magnetic field between 32*a* and 32*b* have the same density, then upward flow of molten metal streams is prevented or slowed. This reduces the upward stream flow speed and reduces transportation of the heat of molten metal to the meniscus, thereby preventing melting of the mold powders at the meniscus. This increases surface defects such as entrapped scum on the surface of cast products, as shown in FIG. 9.

We have invented an apparatus and method to control the magnetic flux density 31, 32 by changing distances between the magnetic poles using a magnetic flux density controlling device 6 installed on iron cores Fa, Fb. According to this continuous casting apparatus, it is now possible to slow the downwardly directed stream greatly to a desired rate of downward movement, yet at the same time avoid excessive slowing of the molten metal movement at the meniscus and increase melting of the mold powders on the meniscus by the heat of the molten metal. This is achieved by increasing the distance between the upper magnetic poles 31*a*, 31*b* and reducing the magnetic flux density of the upper magnetic field compared to the lower magnetic field.

We can also improve casting productivity by this invention because it provides the ability to quickly change the magnetic fields according to casting conditions such as a casting speed and types of steel.

The magnetic flux density controlling device shown in FIG. 15 operates by changing the distance between upper magnetic poles 31*a*, 31*b* by swinging iron core Fb around hinge 9 with a hydraulic cylinder 10.

Figure 16:
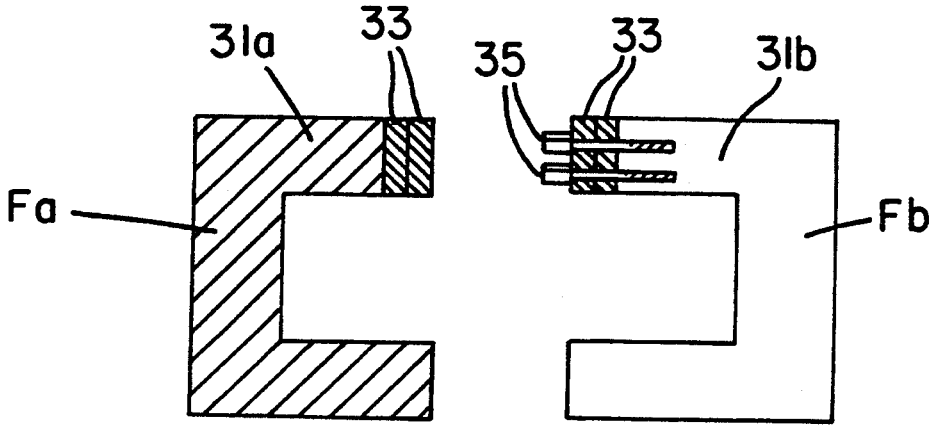
FIG. 16 is a vertical section of a device for changing the distance between magnetic poles with non-magnetic materials.

Another embodiment of the magnetic flux density controlling device can be formed (with reference to FIG. 16) by substituting part of the iron core material of upper magnetic poles 31*a*, 31*b* with a non-magnetic material 33 such as stainless steel, which is secured by bolts 35 and can be removed, which reduces the magnetic flux density of upper magnetic poles 31*a*, 31*b* compared to that of lower magnetic poles 32*a*,32*b*.

This apparatus can be easily adapted to existing continuous casters with a minor change around the casting mold.

EXAMPLES

FIGS. 7–14 of the drawings show examples and comparative examples showing many of the advantages of this invention over the prior art. Other examples are as follows:

Example 1

Low-carbon Al-killed steel (0.015 wt. %≦C≦0.034 wt. %) which was refined in a basic oxygen furnace and treated with Argon flushing was continuously cast in a curved mold continuous caster (shown in FIGS. 1 and 2, for example) under the following conditions:

- Slab cross-section: 220 by 800,1200,1600 mm
- Magnetic pole dimension (band area): 600 by 1600 mm
- Flux density of magnetic field: 2000 Gauss
- Throughput: 3.0–4.0 ton/min.
- Immersion nozzle port area: 150 sq.cm.
- Immersion nozzle outlet angle: upward 5 deg., horizontal, downward 25 deg.
- Immersion nozzle port position: 180–220 mm down from the upper edge of the magnetic pole
- Meniscus level: 30 mm down from the upper edge of the magnetic pole
- Total production: 10–50 heat, 2800–14000 ton These cast slabs were rolled and continuously heat treated to final products. After those stages the surface defects of the final products were examined.

For comparison, using the prior art illustrated in FIG. 3, with the same casting conditions, the surface defects of the final products were also examined.

Figure 7:
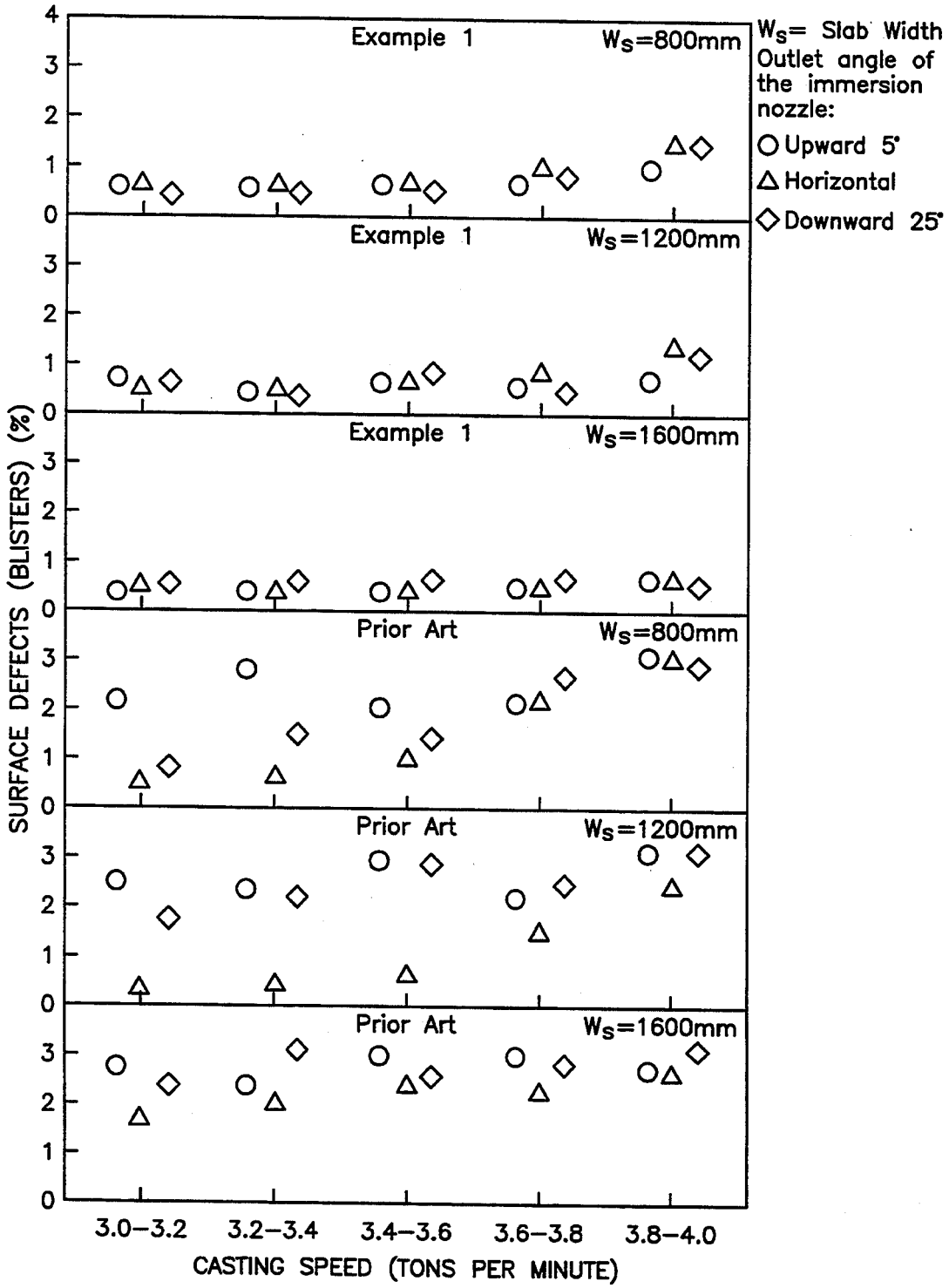
FIG. 7 is a diagram showing the amount of surface defects (blisters) in the final product versus casting speed for Example 1 of the invention and of the prior art.

FIG. 7 shows that the amount of surface defects (blisters) on the final products were greatly reduced by the practice of this invention even when the casting conditions varied widely.

Example 2

Low-carbon Al-killed steel (0.015 wt. %≦C≦0.034 wt. %) which was refined in a basic oxygen furnace and treated with Argon flushing was continuously cast in the curved mold continuous caster (shown in FIGS. 1 and 4, for example) under the following conditions:

- Slab cross-section: 220 by 800,1200,1600 mm
- Magnetic pole dimension (band area): 200 by 1600 mm
- Flux density of magnetic field: 2000 Gauss
- Throughput: 3.0–4.0 ton/min.
- Immersion nozzle port area: 150 sq.cm.
- Immersion nozzle outlet angle: upward 5 deg., horizontal, downward 25 deg.
- Magnetic pole arrangement: Lower edge of the magnetic pole locates 50 mm above the immersion nozzle ports
- Meniscus level: 50 mm down from the upper edge of the magnetic pole

Example 3

Figure 8:
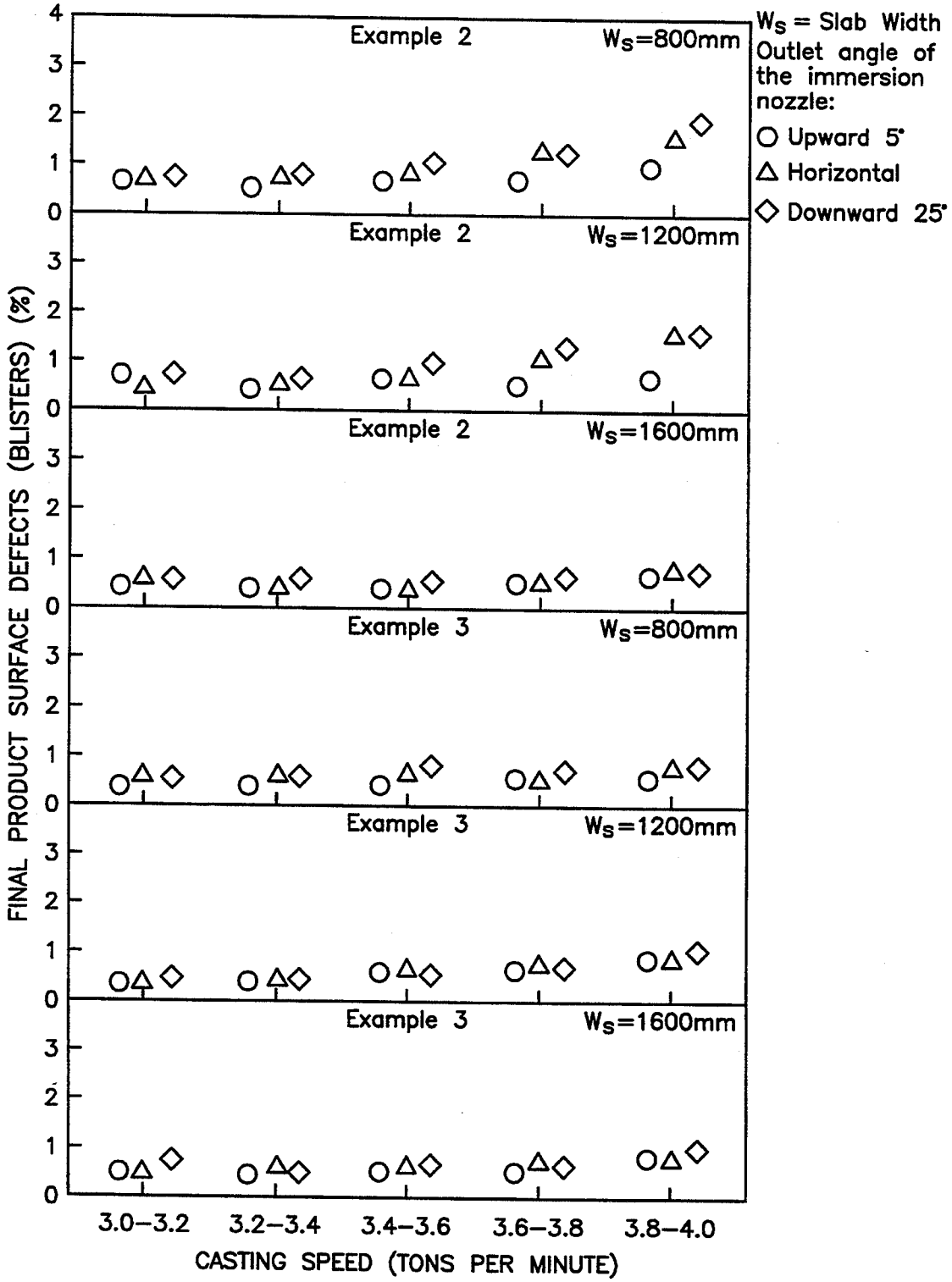
FIG. 8 is a diagram showing the amount of surface defects (blisters) in the final product versus casting speed for Examples 2 and 3 of the invention.

Low-carbon Al-killed steel (0.015 wt. %≦C≦0.034 wt. %) which was refined in a basic oxygen furnace and treated with Argon flushing was continuously cast in the curved mold continuous caster shown in FIG. 6 under the following conditions:

- Slab cross-section: 220 by 800,1200,1600 mm
- Magnetic pole dimension (band area): 200 by 1600 mm
- Flux density of magnetic field: 2000 Gauss
- Throughput: 3.0–4.0 ton/min.
- Immersion nozzle port area: 150 sq.cm.
- Immersion nozzle outlet angle: upward 5 deg., horizontal, downward 25 deg.
- Magnetic pole arrangement: Lower edge of the upper magnetic pole locates 50 mm above the immersion nozzle ports and upper edge of the lower magnetic pole locates 150 mm below the immersion nozzle ports.
- Meniscus level: 50 mm below the upper edge of the upper magnetic pole These cast slabs were rolled and continuously heat treated to final products, after those stages the surface defects of the final products were examined. FIG. 8 shows the amount of surface defects on the final products of Examples 2 and 3. The surface defects (blisters) were greatly reduced by the practice of this invention even when the casting conditions varied widely.

EXAMPLE 4

Low-carbon Al-killed steel for stannous coat steel sheets was continuously cast in curved mold continuous casters of FIGS. 6 and 15 under the following conditions:

- Casting speed: 1.7 m/min
- Slab cross-section: 260 by 1400 mm
- Upper magnetic pole distance: 460–520 mm
- Lower magnetic pole distance: 460 mm
- Flux density of upper magnetic field: 2400–3200 Gauss
- Flux density of lower magnetic field: 3200 Gauss These cast slabs were rolled to form final products, and the surface defects of the cast and final products were examined.

Figure 10:
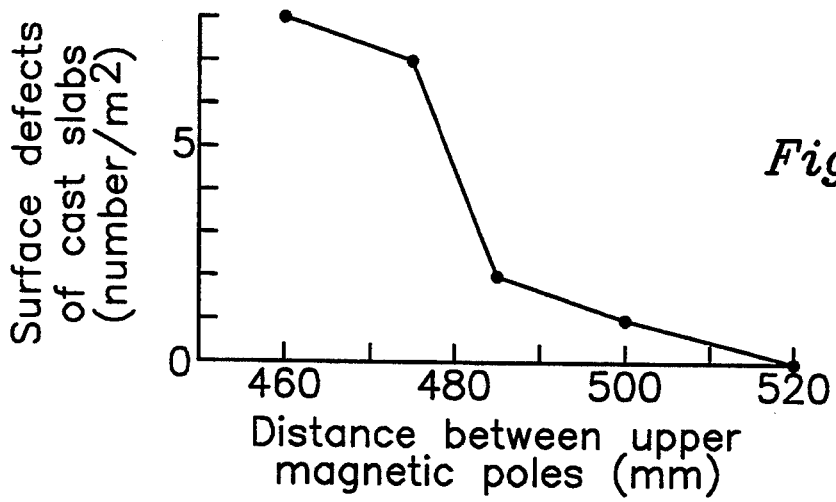
FIG. 10 is a diagram showing the surface defects in the cast product (entrapped scum) versus the distance between the upper magnetic poles.
Figure 11:
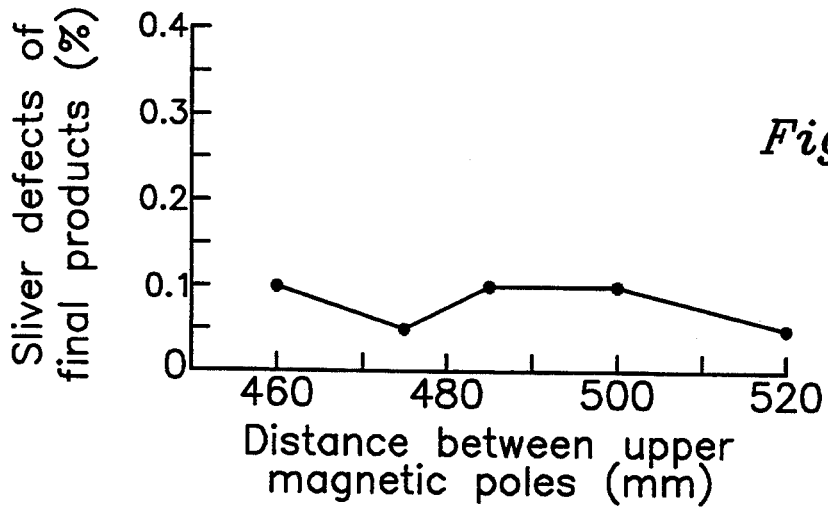
FIG. 11 is a diagram showing the sliver defects (streak defects on the cold rolled metal surface mainly caused by alumina) versus the distance between the upper magnetic poles.

FIG. 10 shows the amount of entrapped scum on the cast products and FIG. 11 shows the sliver defects which are streak defects mainly caused by alumina on the final products. These figures show important advantages of this invention in controlling the magnetic flux density.

Though the cast products of the above mentioned Examples were steel slabs, this invention can be easily applied to other magnetic metals such as iron and to other types of casting machines such as those for blooms or billets.

Although this invention has been described with reference to a variety of selected embodiments, it will be appreciated that various modifications may be made including the substitution of equivalents, reversals of parts, and the use of certain features independently of other features, all without departing from the spirit and scope of the invention as defined in the appended claims.

We claim:

1. In a continuous casting method wherein a stream of molten metal is poured into a casting mold having end walls and side walls that are longer than said end walls, said mold including a nozzle having a discharge opening directed toward at least one of said end walls, the steps which comprise:

(a) applying to said molten metal magnetic fields which cover substantially the entire lengths of said side walls, (b) said fields being effective upon both of said side walls and being spaced above and below said discharge opening, said fields extending continuously along the lengths of said side walls, at locations spaced apart from said nozzle openings.

2. The method of claim 1 in which said magnetic fields are produced by continuous magnets positioned adjacent to said side walls.

3. The method of claim 2 including the step of during pouring controlling the magnetic flux density of a magnetic field in accordance with casting conditions.

4. The method of claim 2, further including the step of controlling the magnetic flux density of one set of magnets to be equal to or less than the magnetic flux density of another set of magnets.

5. The method of claim 2 in which said magnets have iron cores and are mounted outside the side walls of said casting mold, and in which the lengths of said iron cores are equal to or greater than the lengths of said side walls of said casting mold.

6. In a continuous casting method wherein a stream of molten metal is poured into a casting mold having end walls and side walls that are longer than said end walls, having a discharge directed toward at least one of said end walls; the steps which comprise:

(a) directing static magnetic fields in a direction and with an influence to reduce the molten metal stream speed to unify the flow profile of said molten metal in the said mold;

(b) applying to said molten metal spaced-apart magnetic fields which cover substantially the entire width of the casting mold;

(c) one of said fields being located above said nozzle discharge and another of said fields being located below said nozzle discharge, and both of said fields being substantially uniform across the width of said molten metal in said mold.

7. In a continuous casting machine wherein a stream of molten metal is poured into a casting mold through an immersion nozzle having an opening, said mold having end walls and side walls that are longer than said end walls, said stream being directed from said immersion nozzle toward an end wall of said mold, the combination which comprises:

(a) a plurality of magnets positioned to apply a static magnetic field to modify molten metal stream flow in said mold, (b) said magnets being positioned to apply magnetic fields which are as long as or longer than the lengths of said mold side walls, said magnets being located above and below said discharge nozzle opening, and (c) said magnets being arranged in relation to said casting mold to provide substantially uniform magnetic fluxes along the lengths of said side walls.

8. The continuous casting machine of claim 7 in which magnetic flux density control apparatus is provided for changing the distances between said magnets.

9. The continuous casting machine of claim 8 in which said control apparatus includes pivot means connected for controlling the flux densities of said magnets.

10. The continuous casting machine of claim 7 in which magnetic flux density control apparatus is provided for changing the distance between magnetic poles.

11. In a continuous casting method wherein a stream of molten metal is poured through an immersion nozzle having an outlet port extending into a casting mold, and wherein said stream is acted on by static magnetic fields each having a magnetic flux density to reduce the molten metal stream speed to control the flow profile of molten metal from the nozzle; the improvement which comprises the steps of applying to the molten metal separate static magnetic fields of adjustable strength produced by upper and lower pairs of magnetic poles separated by a distance transverse to the molten metal stream, each pole having a predetermined magnetic field strength and orientation, and wherein one said static magnetic field is an upper magnetic field which covers an area from the meniscus down to a position above the outlet port of the immersion nozzle and which covers substantially the entire width of the casting mold in a direction transverse of the molten metal stream direction, and another static magnetic field covers substantially an area from lower-end line of the casting mold up to a portion below the outlet port of said immersion nozzle, and which also covers substantially the entire width of the casting mold in a direction transverse of the molten metal stream direction and including the step of adjusting the magnetic flux density of the magnetic field across substantially the entire width of the molten metal flow to control the direction of the metal stream exiting from the nozzle in which the magnetic flux density of the upper magnetic pole is controlled to be equal to or less than the magnetic flux density of the lower magnetic pole by changing the distance between each of said pair of upper and lower magnetic poles.

12. In a continuous casting method wherein a stream of molten metal is poured by an immersion nozzle having an outlet port extending into a casting mold and wherein said stream is acted on by static magnetic fields to reduce the molten metal stream speed to control the flow profile of molten metal from the nozzle; the improvement which comprises the steps of applying to the molten metal two static magnetic fields of adjustable strength produced by magnetic poles each having a predetermined magnetic field strength and orientation, and wherein said static magnetic field covers an upper magnetic field, an area from meniscus down to a portion which does not include the outlet port of the immersion nozzle and a lower magnetic field, an area from lower-end line of the casting mold up to a portion which does not include the outlet port of said immersion nozzle and also cover the entire width of the casting mold in a direction transverse of the molten metal stream direction and including the step of controlling the magnetic flux density of the magnetic field in accordance with the casting condition wherein a portion of iron core of said upper magnetic pole is replaced with a non-magnetic material to locally reduce magnetic flux density.

13. In a continuous casting method wherein a stream of molten metal is poured by an immersion nozzle having an outlet port extending into a casting mold and wherein said stream is acted on by static magnetic fields to reduce the molten metal stream speed to control the flow profile of molten metal from the nozzle; the improvement which comprises the steps of applying to the molten metal two static magnetic fields of adjustable strength produced by magnetic poles each having a predetermined magnetic field strength and orientation, and wherein said static magnetic field covers an upper magnetic field, an area from meniscus down to a portion which does not include the outlet port of the immersion nozzle and a lower magnetic field, an area from lower-end line of the casting mold up to a portion which does not include the outlet port of said immersion nozzle and also cover the entire width of the casting mold in a direction transverse of the molten metal stream direction and including the step of controlling the magnetic flux density of the magnetic field in accordance with the casting condition wherein said magnetic flux density of the upper magnetic pole is controlled by changing the distance between the poles with a cylinder having a pivot as a center.

14. The method of claims 11, 12 or 13 in which the distance between the upper and lower magnetic fields is 200 mm.

15. In a continuous casting machine wherein a stream of molten metal is poured by an immersion nozzle having an outlet port extending into a casting mold and wherein said stream is acted on by static magnetic fields to reduce the molten metal stream speed to control the flow profile of molten metal from said nozzle; the improvement which comprises providing two magnetic poles which consist of an upper magnetic pole covering an area from the meniscus down to a portion above the outlet port of the immersion nozzle and a lower magnetic pole covering an area from the lower end line of the casting mold up to the outlet port of said immersion nozzle, and are at least as wide as or wider than the minimum width of the cast products, and wherein the magnetic fields are produced by an iron core arranged on a face of the casting mold with mutually opposite polarities in the drawing direction, said iron core being arranged to provide an adjustable uniform magnetic flux across the width of said molten metal and in which magnetic flux density control apparatus is provided for changing the distance between the upper magnetic poles as measured transverse to the strand drawing direction by changing the distance between the poles with a cylinder having a pivot as the center.

16. In a continuous casting machine wherein a stream of molten metal is poured by an immersion nozzle having an outlet port extending into a casting mold and wherein said stream is acted on by static magnetic fields to reduce the molten metal stream speed to control the flow profile of molten metal from said nozzle; the improvement which comprises providing two magnetic poles which consist of an upper magnetic pole covering an area from the meniscus down to a portion above the outlet port of the immersion nozzle and a lower magnetic pole covering an area from the lower end line of the casting mold up to the outlet port of said immersion nozzle, and are at least as wide as or wider than the minimum width of the cast products, and wherein the magnetic fields are produced by an iron core arranged on a face of the casting mold with mutually opposite polarities in the drawing direction, said iron core being arranged to provide an adjustable uniform magnetic flux across the width of said molten metal and in which magnetic flux density control apparatus is provided with a portion of iron core of the upper magnetic pole being replaced with a non-magnetic material to locally reduce magnetic flux density.

* * * * *